US009035205B2

(12) United States Patent
Chou

(10) Patent No.: US 9,035,205 B2
(45) Date of Patent: May 19, 2015

(54) MULTI-DIRECTIONAL TILT SWITCH

(71) Applicant: Tien-Ming Chou, Taichung (TW)

(72) Inventor: Tien-Ming Chou, Taichung (TW)

( * ) Notice: Subject to any disclaimer, the term of this patent is extended or adjusted under 35 U.S.C. 154(b) by 128 days.

(21) Appl. No.: 13/734,291

(22) Filed: Jan. 4, 2013

(65) Prior Publication Data

US 2014/0034460 A1 Feb. 6, 2014

(51) Int. Cl.
*H01H 35/02* (2006.01)
*H01H 35/14* (2006.01)

(52) U.S. Cl.
CPC ..... *H01H 35/02* (2013.01)

(58) Field of Classification Search
CPC ..... H01H 35/14; G01B 11/26; G01D 5/34; G01C 9/10
USPC ..... 200/61.45 R–61.45 M
See application file for complete search history.

(56) References Cited

U.S. PATENT DOCUMENTS

| | | | | |
|---|---|---|---|---|
| 6,180,873 | B1 * | 1/2001 | Bitko | 174/9 F |
| 7,045,724 | B1 | 5/2006 | Chou | |
| 7,319,200 | B2 * | 1/2008 | Chou et al. | 200/61.45 R |
| 7,446,272 | B2 | 11/2008 | Chou | |

FOREIGN PATENT DOCUMENTS

| | | |
|---|---|---|
| TW | I239025 B | 9/2005 |
| TW | I310951 B | 6/2009 |

* cited by examiner

*Primary Examiner* — Edwin A. Leon
*Assistant Examiner* — Anthony R. Jimenez
(74) *Attorney, Agent, or Firm* — The Webb Law Firm

(57) ABSTRACT

A multi-directional tilt switch includes a housing inner surface defining a chamber, a housing outer surface opposite to the housing inner surface, a plurality of slots extending through the housing inner and outer surfaces, and a plurality of conductive terminals each including an insert portion inserted in a corresponding slot, a contact portion extending into the chamber, and a first connecting surface exposed from the housing outer surface. A conductive body is accommodated movably in the chamber between a first position, where the conductive body bridges two contact portions, and a second position, where the conductive body does not bridge any two contact portions.

10 Claims, 10 Drawing Sheets

MULTI-DIRECTIONAL TILT SWITCH

FIELD OF THE INVENTION

The invention relates to a tilt switch, more particularly to a multi-directional tilt switch that uses angular changes to effect ON/OFF switching.

DESCRIPTION OF THE RELATED ART

Referring to FIG. 1, a rolling-ball switch 1, as disclosed in Taiwanese Patent No. 1310951, mainly comprises a housing 11 defining a chamber 10, two conductive terminals 12, 13, and a conductive ball 14 disposed in the chamber 10. Each of the conductive terminals 12, 13 has a plate shape, and includes two contact portions 121, 131 extending into the chamber 10, and an elongated connecting portion 122, 132 exposed from the housing 11. The contact portions 121, 131 are disposed in pairs around the conductive ball 14. Through such a configuration, when the rolling-ball switch 1 produces an angular change due to vibration, and the conductive ball 14 contacts simultaneously one of the contact portions 121 and one of the contact portions 131, the circuit of the switch 1 is closed to place the switch 1 in an ON state. When the conductive ball 14 does not contact simultaneously one of the contact portions 121 and one of the contact portions 131, the circuit of the switch 1 is open to place the switch 1 in an OFF state.

However, the ON/OFF switching of the rolling-ball switch 1 can be achieved through a single direction only, but not multiple directions. Further, although the connecting portions 122, 132 can utilize bottom and lateral sides thereof as connecting surfaces having large areas and different orientations, they only increase the overall height of the rolling-ball switch 1 and occupy a large space.

Referring to FIG. 2, a rolling-ball switch 2, as disclosed in Taiwanese Patent No. 1239025, is shown to be similar to the aforesaid rolling-ball switch 1. Particularly, the rolling-ball switch 2 comprises a housing 21 defining a chamber 20, four conductive terminals 22, and a conductive ball 23 disposed in the chamber 20. The difference between the two resides in that each of the conductive terminals 22 is configured as an elongated strip, and includes a contact portion 221 extending into the chamber 10, and a connecting portion 222 exposed from the housing 11. Through this configuration, the conductive ball 23 is movable in the chamber 10 between a closed circuit position, where the conductive ball 23 contacts simultaneously two of the contact portions 221, and an open circuit position, where the conductive ball 23 does not contact simultaneously two of the contact portions 221. Hence, ON/OFF switching of the rolling-ball switch 2 can be achieved through multiple directions. However, the exposed connecting portions 222 of the conductive terminals 22 can similarly increase the overall height of the rolling-ball switch 2 and occupy a large space. Further, because each conductive terminal 22 is elongated, it has a small soldering area, and can be soldered along one direction only.

With reference to FIGS. 1 and 2, it is worth to mention that the housing 11, 21 of each of the aforementioned switches 1, 2 includes interconnected base 111, 211 and cover 112, 212. Through a welding tool that employs an ultrasonic vibration method, a mortise (not shown) formed on the cover 112, 212 can be melted to fuse with the base 111, 211.

However, with the advancement of technology, the design of electronic components tends to progress toward precision and miniaturization. Therefore, to miniaturize the rolling-ball switch 1, 2 and to avoid excessive glue that is caused by large contact areas and that can affect the aesthetics and deformation before welding, the size of the mortise must be reduced. Thus, in the case where there is only one mortise, because of the defects during injection molding or insufficient welding area, the consolidation strength and the sealing effect between the base 111, 211 and the cover 112, 212 are easily and adversely affected. Relatively speaking, the waterproof requirement cannot also be met.

SUMMARY OF THE INVENTION

Therefore, an object of the present invention is to provide a multi-directional tilt switch that can occupy a minimum space and that has a minimum overall height.

According to this invention, a multi-directional tilt switch comprises a housing, a plurality of conductive terminals and a conductive ball. The housing has a housing inner surface defining a chamber, a housing outer surface opposite to the housing inner surface, and a plurality of slots extending through the housing inner and outer surfaces. Each of the conductive terminals includes an insert portion inserted in a corresponding one of the slots and elongated along a first direction, a contact portion extending from one end of the insert portion into the chamber along a second direction that is transverse to the first direction, and a first connecting surface that is formed on another end of the insert portion oppositely of the contact portion, that extends along the first direction, and that is exposed from the corresponding slot and from the housing outer surface. The contact portions of the conductive terminals are arranged in an array. The conductive body is accommodated in the chamber, and is movable in the chamber between a first position, where the conductive body contacts and bridges two of the contact portions, and a second position, where the conductive body does not contact and bridge any two of the contact portions.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

The above-mentioned and other technical contents, features, and effects of this invention will be clearly presented from the following detailed description of one embodiment in coordination with the reference drawings.

Figure 1:
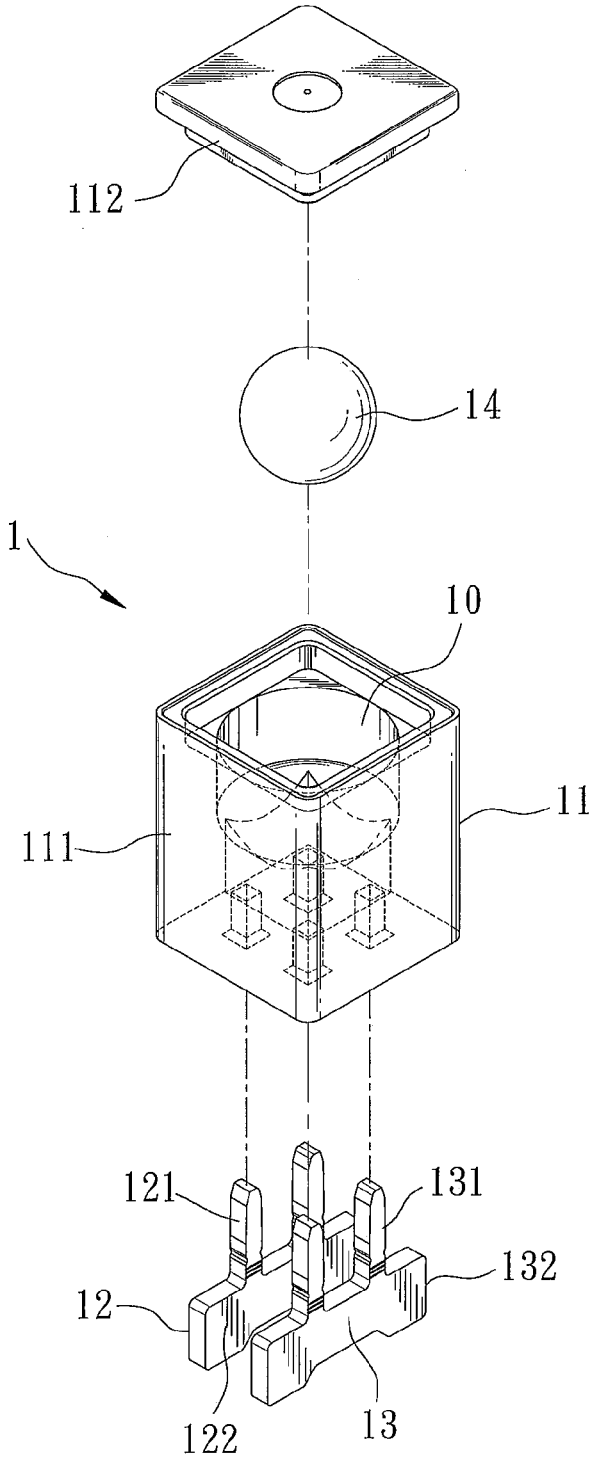
FIG. 1 PRIOR ART
FIG. 1 is an exploded perspective view of a rolling-ball switch disclosed in Taiwanese Patent No. 1310951.
Figure 2:
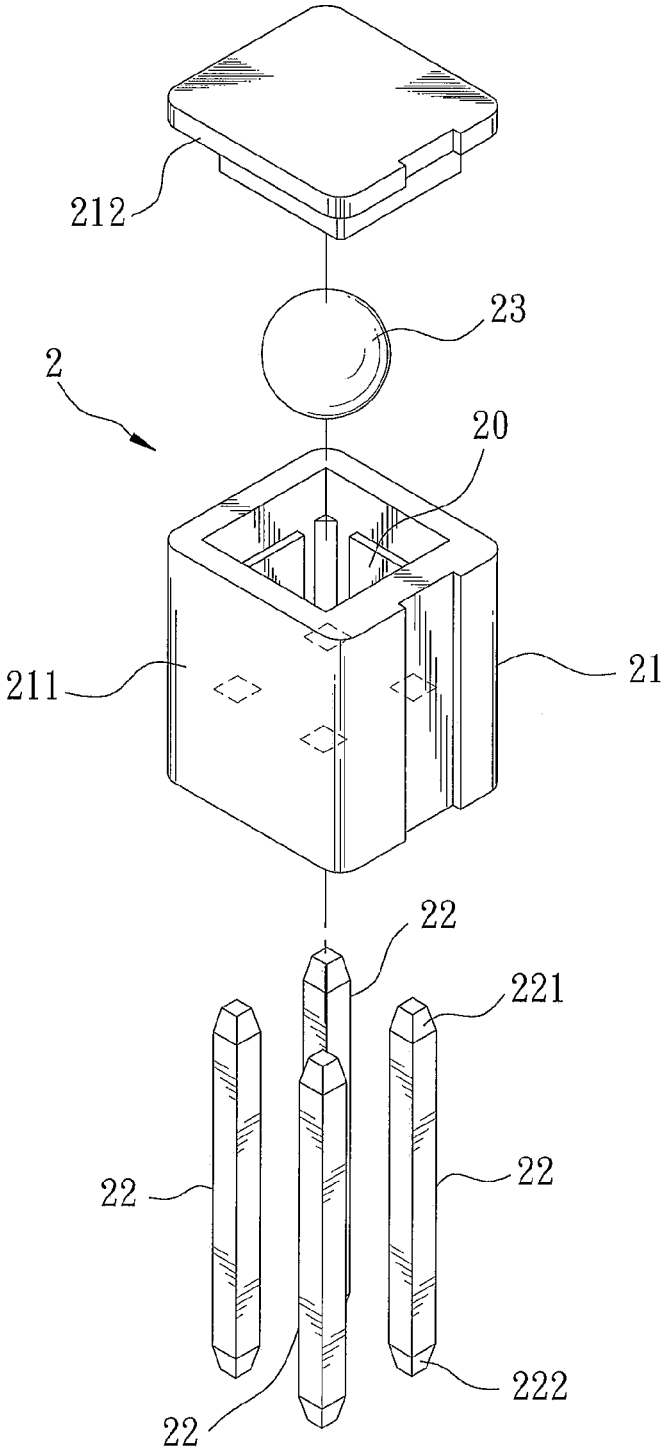
FIG. 2 PRIOR ART
FIG. 2 is an exploded perspective view of a rolling-ball switch disclosed in Taiwanese Patent No. 1239025.
Figure 3:
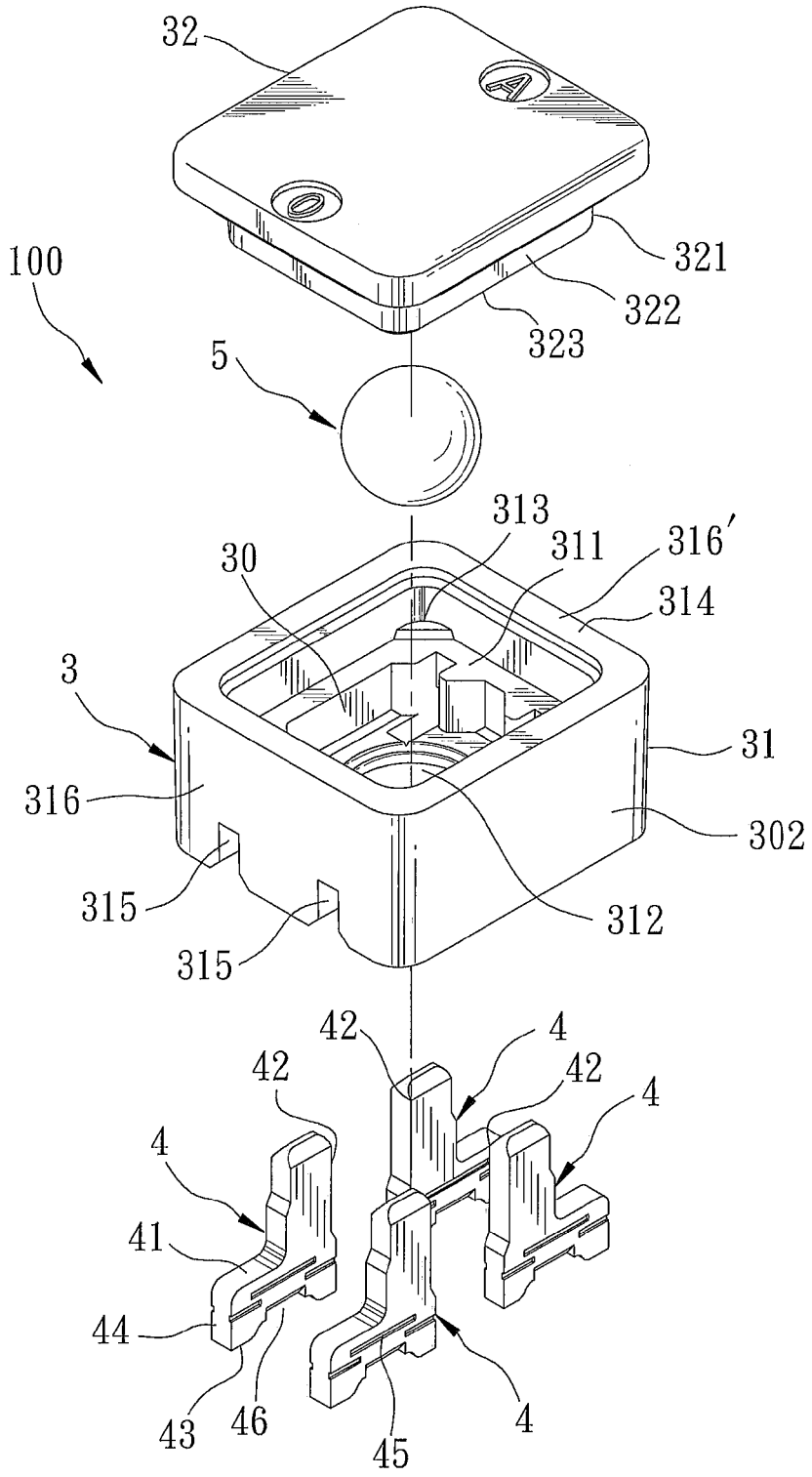
FIG. 3 is an exploded perspective view of a multi-directional tilt switch according to the preferred embodiment of this invention.
Figure 4:
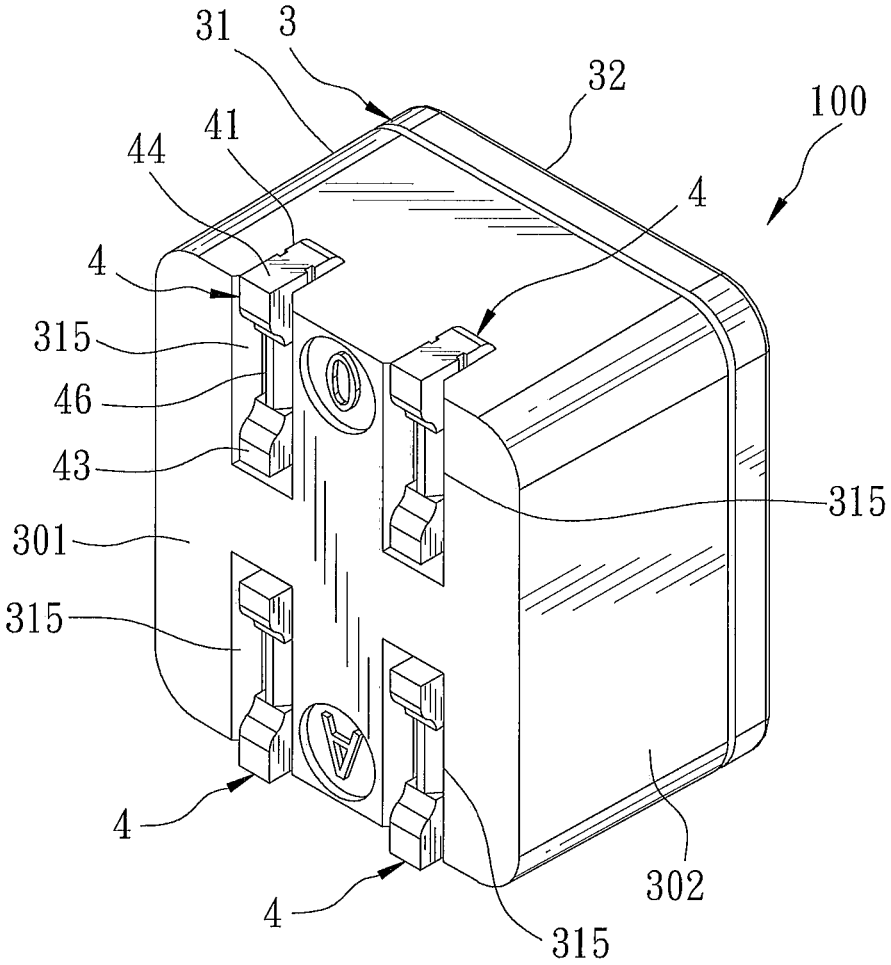
FIG. 4 is an assembled perspective view of the preferred embodiment.
Figure 5:
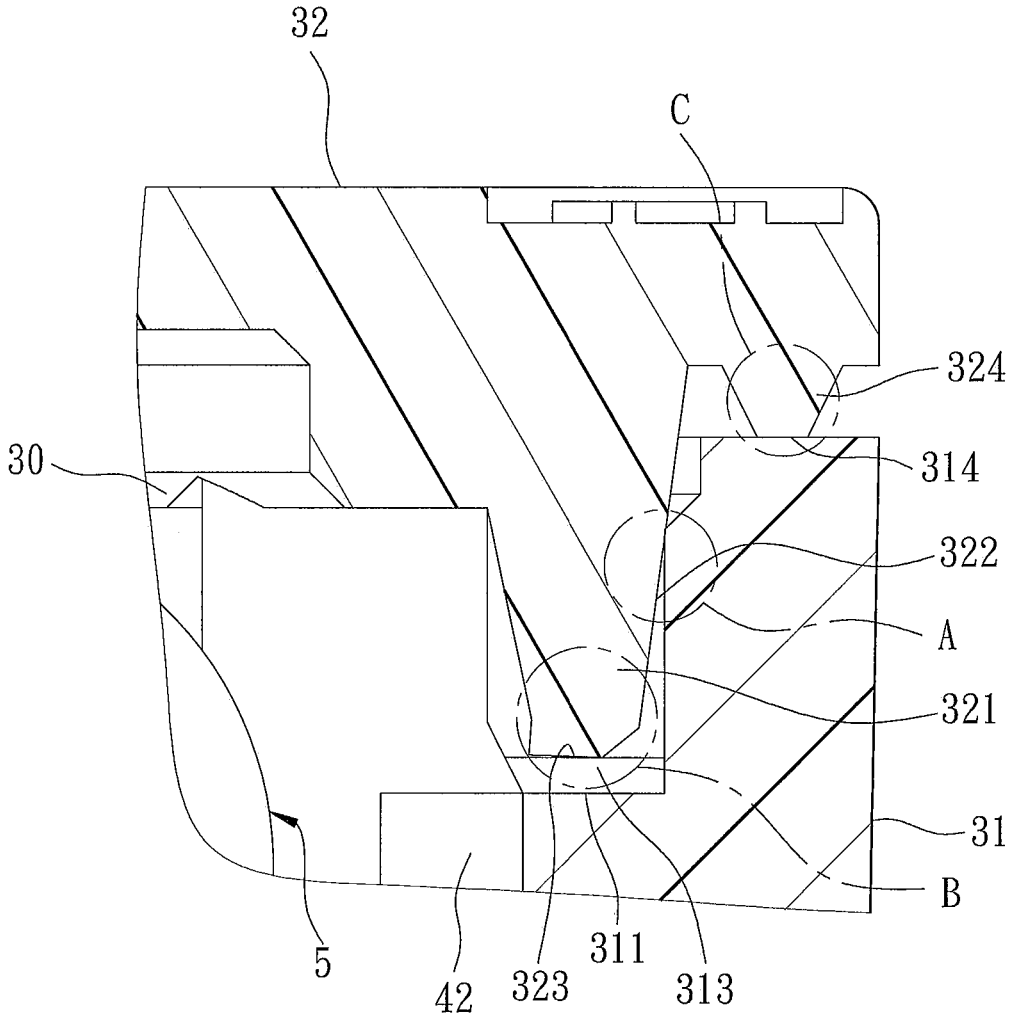
FIG. 5 is a fragmentary enlarged sectional view of the preferred embodiment before welding.

Referring to FIGS. 3, 4 and 5, the preferred embodiment of a multi-directional tilt switch 100 according to this invention is shown to comprise a housing 3, four spaced-apart conductive terminals 4, and a conductive body 5.

The housing 3 has a housing inner surface defining a chamber 30, a housing outer surface opposite to the housing inner surface, and a plurality of slots 315 extending through the housing inner and outer surfaces. Preferably, the housing 3 includes a base 31 and a cover 32 that are bonded to each other to define the chamber 30. The base 31 includes a base wall 301 opposite to the cover 32, and a surrounding wall 302 extending transversely from the base wall 301 to the cover 32. The base wall 301 has an indentation 312 formed in an inner surface thereof and communicating with the chamber 30. The surrounding wall 302 has a wall end face 314 facing the cover 32, and a wall inner surface that forms a portion of the housing inner surface and that is stepped to form a wall shoulder 311 surrounding the chamber 30. Four spaced-apart welding parts 313 are formed on the wall shoulder 311. The cover 32 has an annular protrusion 321 projecting from an inner surface thereof toward the base 31, and an annular flange 324 surrounding the annular protrusion 321. The annular protrusion 321 projects farther away from the inner surface of the cover 32 than the annular flange 324, and has a protrusion outer surface 322, and a protrusion end face 323 facing the wall shoulder 311.

In this embodiment, the housing 3 has four spaced-apart slots 315 disposed around the indentation 312. Two of the slots 315 extend through the base wall 301, and are lengthened to extend to a juncture of the base wall 301 and one wall portion 316 of the surrounding wall 302 and to extend further to the wall portion 316 from the juncture. The other two slots 315 extend through the base wall 301, and are lengthened to extend to a juncture of the base wall 301 and the other opposite wall portion 316' of the surrounding wall 302 and to extend further to the wall portion 316' from the juncture. That is, each of the slots 315 has a length that extends along a first direction, and a depth that extends along a second direction that is transverse to the first direction. The base 31 and the cover 32 are coupled to each other along the second direction. Although the four slots 315 are spaced apart from each other in this embodiment, in an alternative embodiment, each two of the slots 315 that are aligned along the first direction may be integrally and spatially connected to each other.

Each of the conductive terminals 4 has a thin plate shape, and includes an insert portion 41 inserted in a respective one of the slots 315 and elongated along the first direction, a contact portion 42 extending from one end of the insert portion 41 into the chamber 30 along the second direction, a first connecting surface 43 that is formed on another end of the insert portion 41 oppositely of the contact portion 42, that extends along the first direction, and that is exposed from the respective slot 315 and from an outer surface of the base wall 301, a second connecting surface 44 that is formed from a second another end of the insert portion 41 oppositely of the contact portion 42, that extends along the second direction from the first connecting surface 43, and that is exposed from the respective slot 315 and from an outer surface of the surrounding wall 302, two groove patterns 45 respectively formed on two opposite lateral surfaces of the insert portion 41, and a notch 46 formed in the first connecting surface 43. The contact portions 42 of the conductive terminals 4 are arranged in an array. The contact portions 42 of each two adjacent ones of the conductive terminals 4 are spaced apart from each other by a distance (d) (see FIG. 8).

Figure 6:
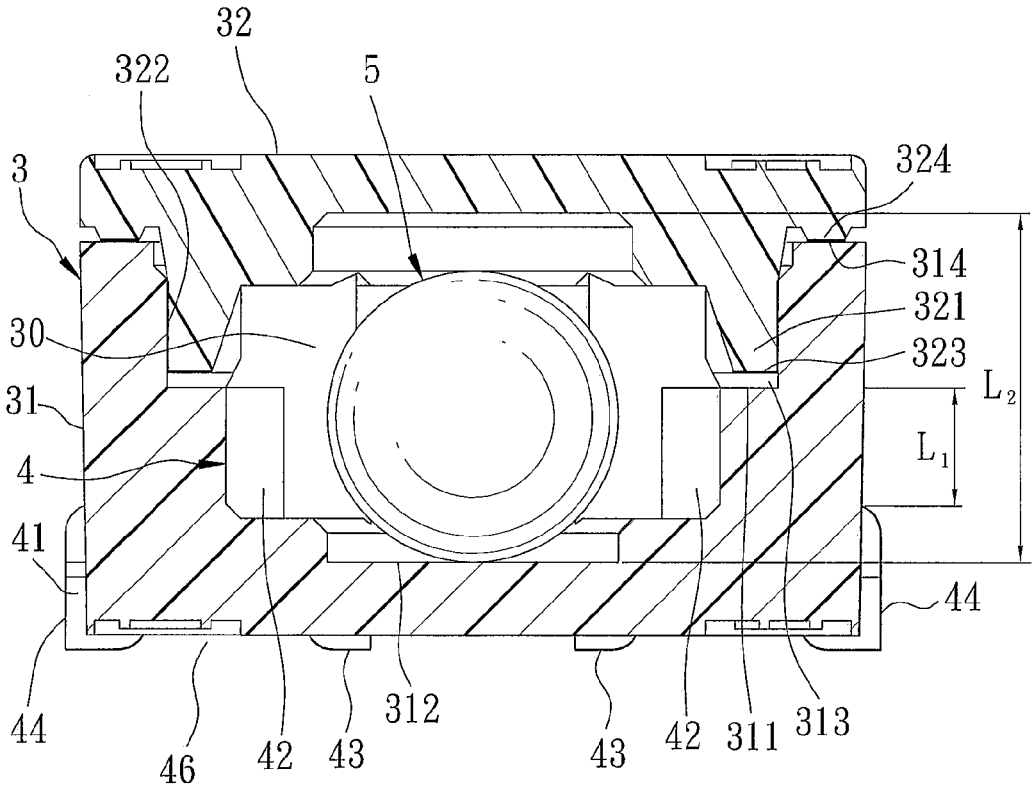
FIG. 6 is an assembled sectional view of the preferred embodiment.

Referring to FIG. 6, the contact portion 42 of each conductive terminal 4 has a length ($L_1$) along the second direction that is larger than one-third of the depth ($L_2$) of the chamber 30 along the second direction. The sum of the lengths of the insert portions 41 (see FIG. 3) of two of the conductive terminals 4 which are aligned along the first direction is larger than one-half of a length of the housing 3 along the first direction. The first connecting surface 43 of each conductive terminal 4 is spaced apart from the outer surface of the base wall 301 by a distance of 0 to 1mm. The second connecting surface 44 of each conductive terminal 4 is spaced apart from the outer surface of the surrounding wall 302 by a distance of 0 to 1mm.

Figure 9:
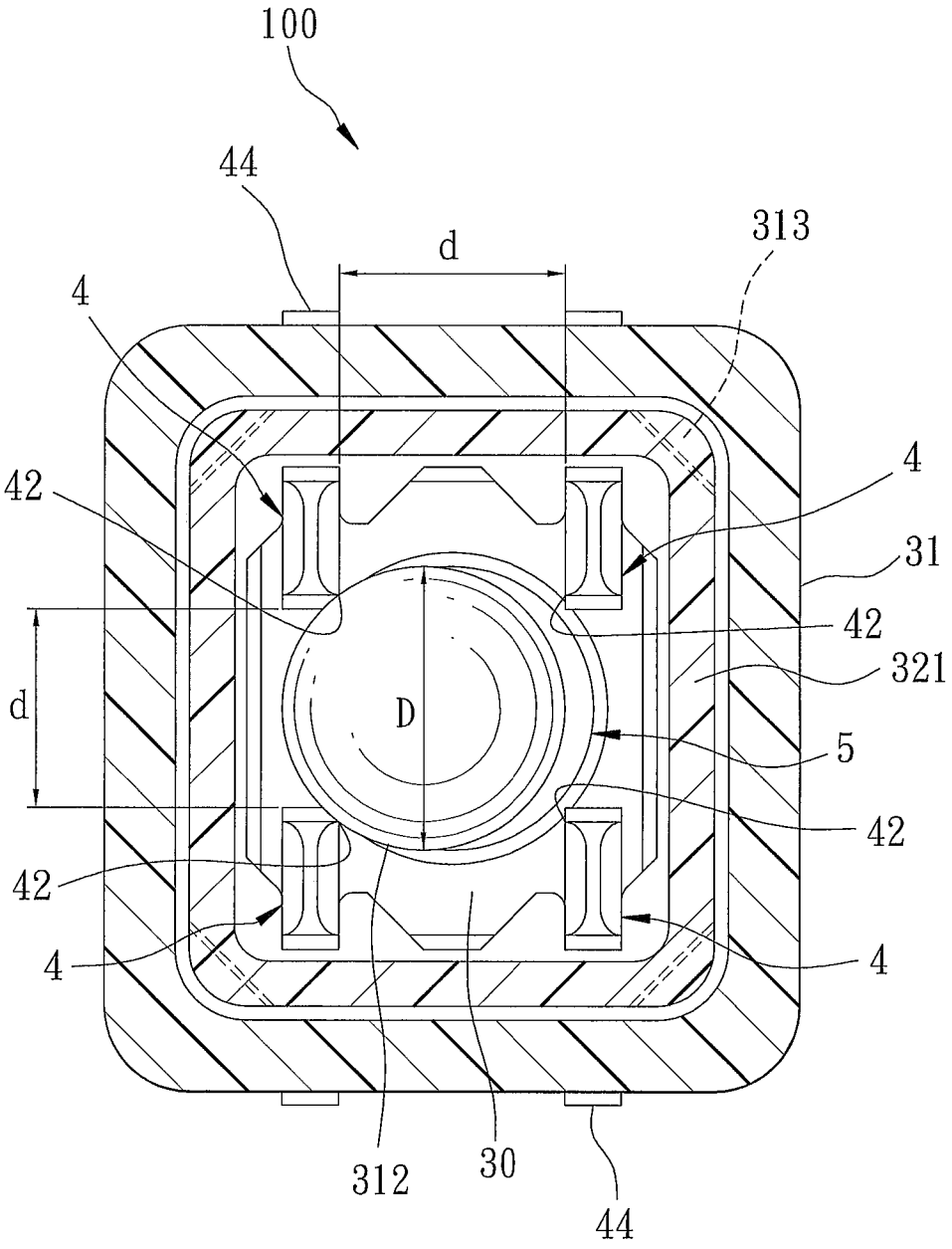
FIG. 9 is a view similar to FIG. 8, but illustrating the conductive ball being disposed in a first position, where the conductive ball contacts and bridges the contact portions of two of the conductive terminals that are spaced apart along a first direction.
Figure 10:
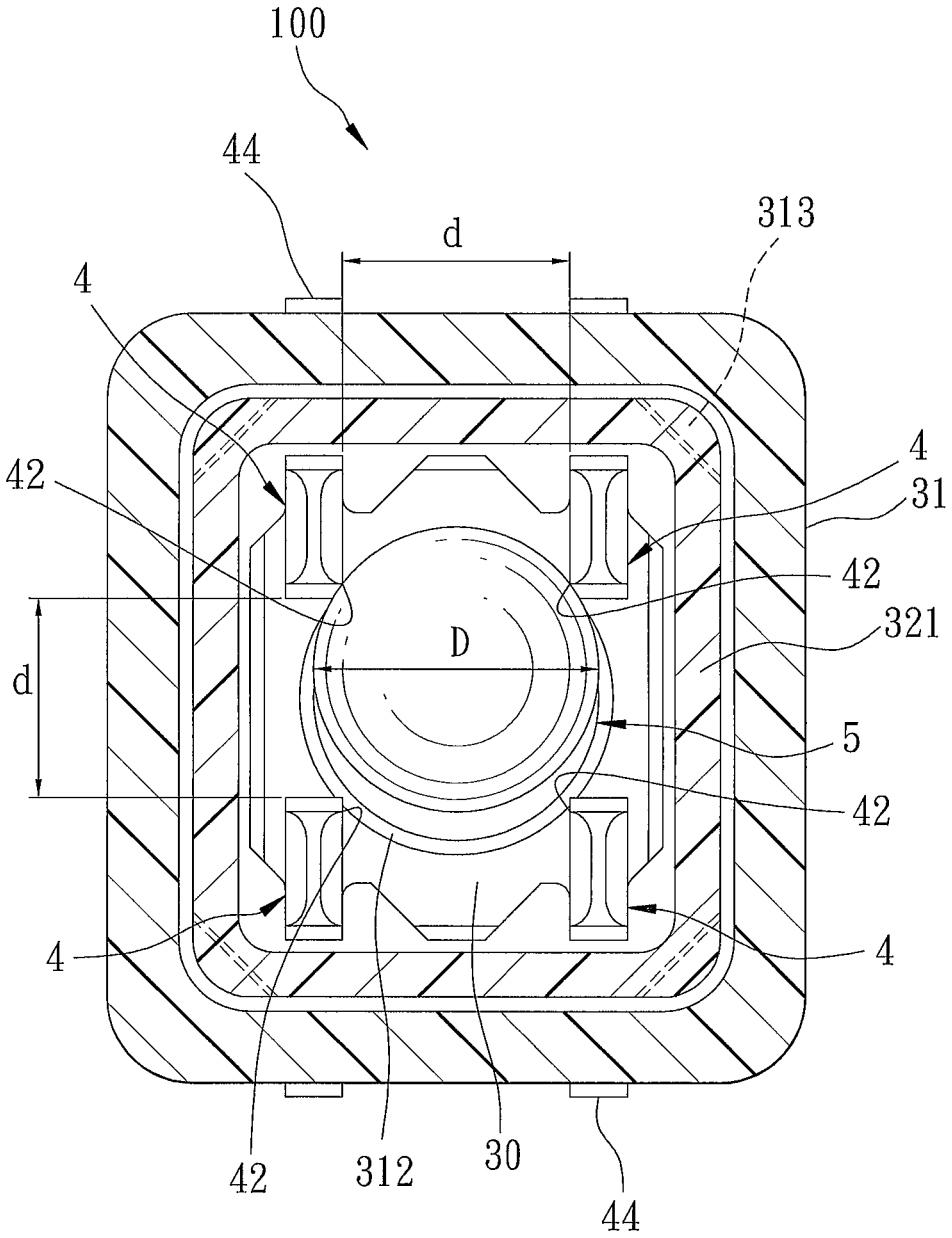
FIG. 10 is a view similar to FIG. 9, but illustrating the conductive ball contacting and bridging the contact portions of two of the conductive terminals that are spaced apart along a second direction.

In this embodiment, the conductive body 5 is configured as a ball that is accommodated in the chamber 30 and that has a largest diameter (D) (see FIG. 8) larger than the aforementioned distance (d). The conductive body or ball 5 is movable in the chamber 30 between a first position and a second position. In the first position, as shown in FIGS. 9 and 10, the conductive ball 5 contacts and bridges the contact portions 42 of two of the conductive terminals 4. In the second position, the conductive ball 5 does not contact and bridge the contact portions 42 of any two conductive terminals 4, as shown in FIG. 8.

Figure 7:
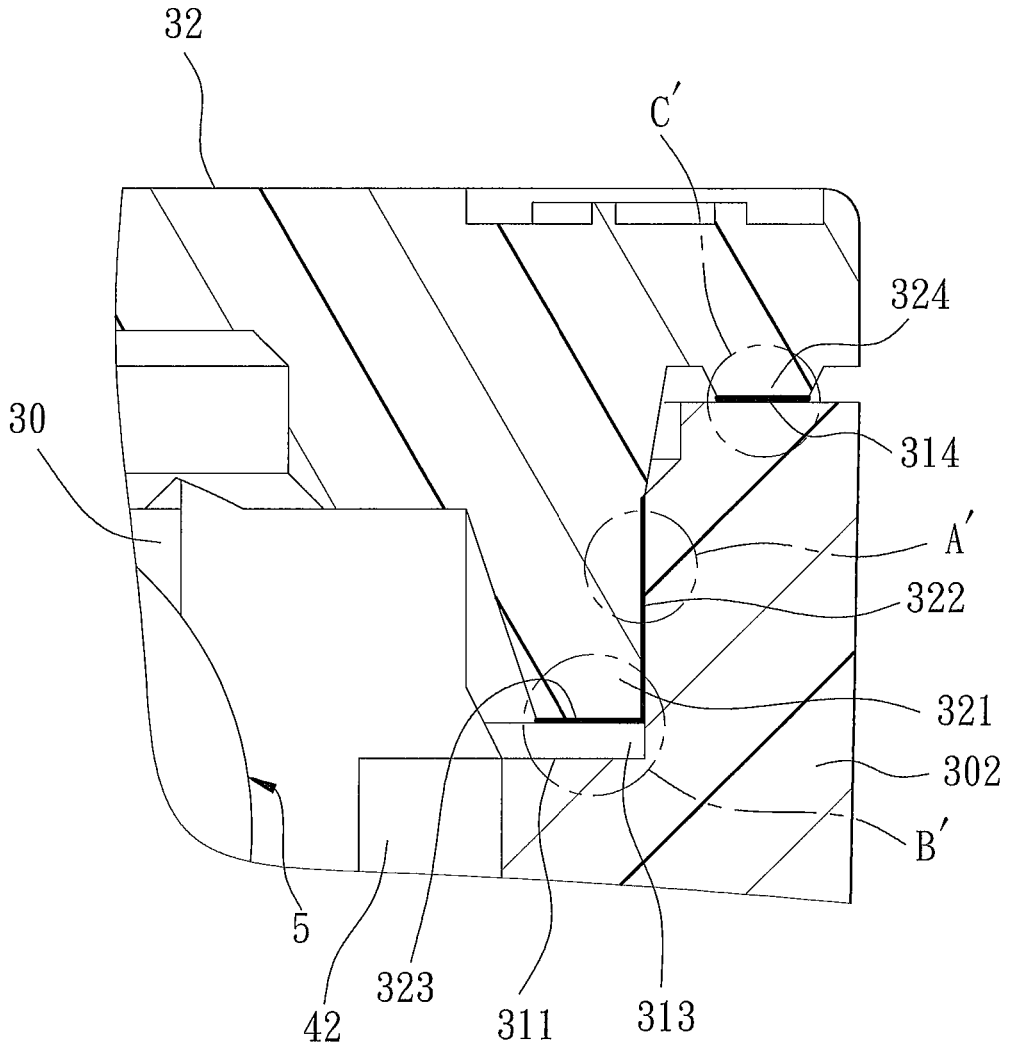
FIG. 7 is a fragmentary enlarged sectional view of the preferred embodiment after welding.

Referring to FIGS. 5 to 7, during welding, the cover 32 and the base 31 are first brought to abut against each other such that the protrusion end face 323 abuts against the welding parts 313 to constitute a contact area (B), the annular flange 324 abuts against the wall end face 314 to constitute a contact area (C), and the protrusion outer surface 322 abuts partially against the wall inner surface of the surrounding wall 302 to constitute a contact area (A). In this embodiment, an ultrasonic welding method is employed so that the contact areas (A), (B) and (C) generate heat by friction as a result of ultrasonic vibration. At this time, the protrusion outer surface 322 and the wall inner surface of the surrounding wall 302 are welded to each other to constitute a first welded joint portion (A'), the protrusion end face 323 and the welding parts 313 are welded to each other to constitute a second welded joint portion (B'), and the annular flange 324 and the wall end face 314 of the surrounding wall 302 are welded to each other to constitute a third welded joint portion (C').

Referring again to FIG. 6, because the first and second connecting surfaces 43, 44 of the conductive terminals 4 are exposed from the housing outer surface of the housing 3 through the corresponding slots 315, the multi-directional tilt switch 100 can be soldered to aboard (not shown) along the first direction through the first connecting surfaces 43 of the conductive terminals 43 or along the second direction through the second connecting surfaces 44 of the conductive terminals 4. It is worth to mention that, during soldering, the groove patterns 45 can prevent solder materials from overflowing through clearances between the housing 3 and the conductive terminals 4 during insertion of the latter into the housing 3. Further, through the presence of the notches 46 in the conductive terminals 4, the conductive terminals 4 can have a large bonding area with the board, and the amount of the solder materials can be enhanced.

Figure 8:
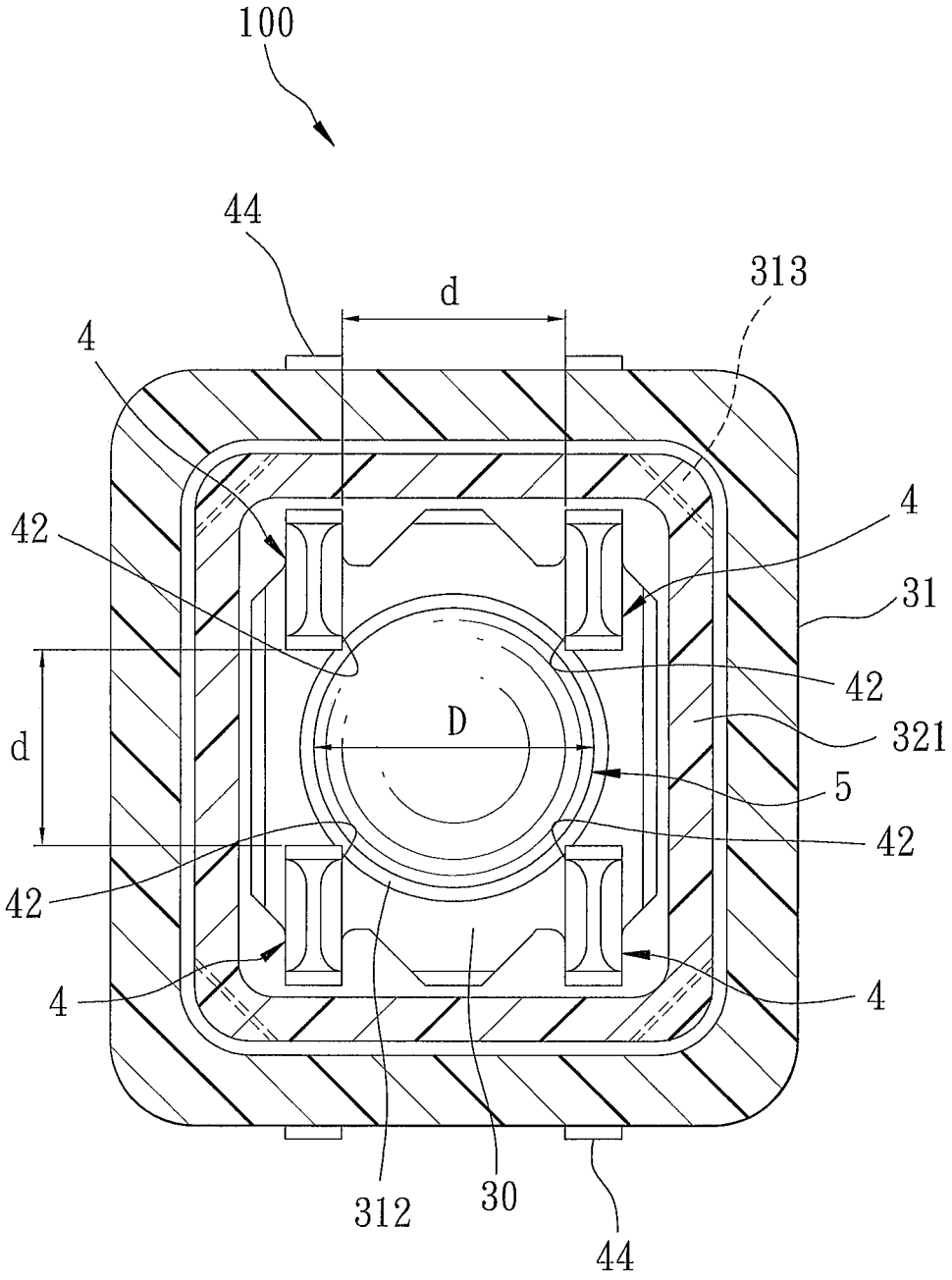
FIG. 8 is a sectional top view of the preferred embodiment, illustrating a conductive ball being disposed in an indentation and surrounded by contact portions of conductive terminals.

Referring to FIG. 8, when the conductive ball 5 is received in the indentation 312, and the conductive ball 5 is surrounded by and does not contact the contact portions 42 of any two of the conductive terminals 4, the circuit of the tilt switch 100 is open to place the tilt switch 100 in an OFF state. Referring to FIGS. 9 and 10, when the tilt switch 100 is tilted by an external force, the conductive ball 5 rolls within the chamber 30 to contact and bridge the contact portions 42 of any two adjacent ones of the conductive terminals 4 following the direction of the external force so as to close the circuit of the tilt switch 100 to thereby switch the tilt switch 100 from the OFF state to an ON state.

From the aforesaid description, the advantages and effects of the multi-directional tilt switch 100 of this invention can be summarized as follows:

1. By using the limiting relationship among the surfaces and the different dispositions of the first welded joint portion (A'), the second welded joint portion (B') and the third welded joint portion (C'), welding areas can be significantly increased, thereby enhancing the bonding strength and the sealing effect of this invention.

2. By arranging the conductive terminals 4 in an array, the conductive body or ball 5 can move within the chamber 30 between the first position that closes the circuit of the tilt switch 100 and the second position that opens the circuit of the tilt switch 100 according to the direction of the external force applied to the tilt switch 100. As such, the present invention can generate ON/OFF switching in different angles.

3. Because the housing 3 is formed with the slots 315 that can hide and receive the insert portions 41 of the conductive terminals 4, respectively, and the conductive terminals 4 are configured as thin plates, a soldering area of the tilt switch 100 may be increased through the first connecting surfaces 43 of the conductive terminals 4 which are exposed from the corresponding slots 315 along the first direction or through the second connecting surfaces 44 of the conductive terminals 4 which are exposed from the corresponding slots 315 along the second direction. As such, the overall height of and the space occupied by the tilt switch 100 is significantly reduced.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. A multi-directional tilt switch comprising:

a housing having a housing inner surface defining a chamber, a housing outer surface opposite to said housing inner surface, and a plurality of slots extending through said housing inner and outer surfaces;

a plurality of conductive terminals each including an insert portion inserted in a corresponding one of said slots and elongated along a first direction, a contact portion extending from one end of said insert portion into said chamber along a second direction that is transverse to the first direction, and a first connecting surface that is formed on another end of said insert portion oppositely of said contact portion, that extends along the first direction, and that is exposed from the corresponding one of said slots and from said housing outer surface, said contact portions of said conductive terminals being arranged in an array, wherein each terminal of said plurality of conductive terminals further includes a second connecting surface; and a conductive body that is accommodated in said chamber and that is movable in said chamber between a first position, where said conductive body contacts and bridges said contact portions of two of said conductive terminals, and a second position, where said conductive body does not contact and bridge said contact portions of any two of said conductive terminals;

wherein each of said first and second connecting surfaces protrudes from said housing outer surface by a distance of 0 to 1 mm.

2. The multi-directional tilt switch as claimed in claim 1, wherein said contact portion of each said conductive terminal has a length along the second direction that is larger than one-third of the depth of said chamber along the second direction.

3. The multi-directional tilt switch as claimed in claim 1, wherein said conductive body is configured as a ball, and said contact portions of each two adjacent ones of said conductive terminals are spaced apart from each other by a distance which is smaller than a largest diameter of said conductive body.

4. The multi-directional tilt switch as claimed in claim 1, wherein each of said slots has a depth that extends along the second direction, and a length that extends along the first direction, the sum of the lengths of said insert portions of two of said conductive terminals which are aligned along the first direction being larger than one-half of a length of said housing along the first direction.

5. The multi-directional tilt switch as claimed in claim 1, wherein each second connecting surface is formed from a second another end of said insert portion oppositely of said contact portion, that extends along the second direction from said first connecting surface, and that is exposed from the corresponding one of said slots and from said housing outer surface.

6. The multi-directional tilt switch as claimed in claim 1, wherein said first connecting surface is formed with a notch.

7. The multi-directional tilt switch as claimed in claim 1, wherein said housing further has an indentation that is formed in an area of said housing inner surface where said slots are disposed, and that communicates with said chamber, said conductive body being received in said indentation, being surrounded by said contact portions, and does not contact said contact portions.

8. The multi-directional tilt switch as claimed in claim 1, wherein said housing includes a base and a cover that are bonded to each other to define said chamber, said base including a base wall opposite to said cover, and a surrounding wall extending transversely from said base wall to said cover, said surrounding wall having a wall end face abutting against said cover, and a wall inner surface that forms a portion of said housing inner surface and that is stepped to form a wall shoulder surrounding said chamber.

9. The multi-directional tilt switch as claimed in claim 7, wherein said cover includes an annular protrusion projecting from an inner surface of said cover toward said base, and an annular flange surrounding said annular protrusion, said annular protrusion projecting farther away from said inner surface of said cover than said annular flange, said annular protrusion having a protrusion outer surface, and a protrusion end face facing said wall shoulder, said protrusion outer surface and said wall inner surface being welded to each other to constitute a first welded joint portion, said protrusion end face and said wall shoulder being welded to each other to constitute a second welded joint portion, said annular flange and said wall end face being welded to each other to constitute a third welded joint portion.

10. The multi-directional tilt switch as claimed in claim 1, wherein said housing includes a base and a cover that are bonded to each other to define said chamber, said base including a base wall opposite to said cover, and a surrounding wall extending from said base wall to said cover, each of said slots extending through said base wall and being lengthened to extend to a juncture of said base wall and said surrounding wall and to extend further to said surrounding wall from said juncture.

* * * * *